United States Patent [19]

Al-Shaikh

[11] B 3,981,767

[45] Sept. 21, 1976

[54] APPARATUS AND METHOD FOR CONTROLLING THE STOCK FLOW TO A PAPER MACHINE HEADBOX

[75] Inventor: Abdul-Rahman A. Al-Shaikh, Mount Kisco, N.Y.

[73] Assignee: Westvaco Corporation, New York, N.Y.

[22] Filed: June 4, 1971

[21] Appl. No.: 150,142

[44] Published under the second Trial Voluntary Protest Program on January 27, 1976 as document No. B 150,142.

Related U.S. Application Data

[63] Continuation-in-part of Ser. No. 888,431, Dec. 29, 1969, abandoned.

[52] U.S. Cl. ..... 162/198; 162/253; 162/258; 162/262; 162/263; 235/151.1

[51] Int. Cl.[2] ..... D21F 1/06; D21F 1/08

[58] Field of Search ..... 162/252, 253, 192, 262, 162/263, 258, 198; 307/116, 118, 119; 317/137; 235/151.1

[56] References Cited

UNITED STATES PATENTS 3,562,104 2/1971 Taylor ..... 162/258 X

OTHER PUBLICATIONS

Pearson, J. H., "Automatic Headbox Operation" Tappi, vol. 46, No. 10 (10–1963), pp. 192A–195A.

McKnight, I. M., "Dev. in the Wider Appl. of Control to P.M. Flow Boxes" Paper Technology, vol. 7, No. 1, (1966), pp. 45–52.

*Primary Examiner*—S. Leon Bashore
*Assistant Examiner*—Steve Alvo
*Attorney, Agent, or Firm*—W. Allen Marcontell; Richard L. Schmalz

[57] ABSTRACT

In a paper machine headbox system including a stock pump and a headbox receiving stock from the stock pump, the stock pump is shunted by a by-pass line. The stock flow to the headbox is primarily controlled by controlling the by-pass flow in the by-pass line by use of a by-pass flow control valve. When the by-pass flow control valve approaches one of its operating limits, i.e. either full open or full closed, the flow to the by-pass line is manipulated so as to reposition and maintain the by-pass flow control valve within its operating limits. A logic inhibit means, logically responsive to by-pass flow control signals, inhibits the stock flow rate in the main stock line.

34 Claims, 10 Drawing Figures

INVENTOR.
ABDUL-RAHMAN M. AL-SHAIKH
BY
AGENT (Cn) INDICATES COIL OF RELAY n

⊣⊢ Kn INDICATES OUTPUT CONTACT OF RELAY n

------→ INDICATES ACTUATION

| | $SP_{RN} < CS_{BP}$ | $SP_{RN} \geq CS_{BP}$ |
|---|---|---|
| C1 | 1 | 0 |
| C2 | 1 | 0 |
| C3 | 0 | 1 |
| C4 | 0 | 1 |

0 = DE-ENERGIZED
1 = ENERGIZED

INVENTOR.
ABDUL-RAHMAN M. AL-SHAIKH
BY Alfred L. Michaelsen
AGENT

INHIBITOR STATUS VS. BY-PASS VALVE POSITION

INVENTOR
ABDUL-RAHMAN M. AL-SHAIKH

BY Alfred L. Michaelsen

AGENT

INVENTOR.
ABDUL-RAHMAN M. AL-SHAIKH
BY
Alfred L. Michaelson
AGENT

INVENTOR.
ABDUL-RAHMAN M. AL-SHAIKH
BY
Alfred L. Michaelsen
AGENT

INVENTOR.
ABDUL-RAHMAN M. AL-SHAIKH
BY
AGENT

INVENTOR.
ABDUL-RAHMAN M. AL-SHAIKH
BY
AGENT.

INVENTOR.
ABDUL-RAHMAN M. AL-SHAIKH
BY Alfred L. Michaelson
AGENT.

APPARATUS AND METHOD FOR CONTROLLING THE STOCK FLOW TO A PAPER MACHINE HEADBOX

CROSS REFERENCE TO RELATED APPLICATION

This application is a continuation-in-part of my earlier copending application Ser. No. 888,431 filed Dec. 29, 1969 and now abandoned.

BACKGROUND OF THE INVENTION a. Field to which the invention pertains

In the manufacture of paper, a dilute aqueous slurry is deposited on a moving foraminous belt. When the water drains away, the cellulose fibers in the slurry form the resulting paper sheet.

In order to obtain a sheet which has the desired specifications, e.g. thickness and the basis weight, it is imperative that the quantity and velocity of the slurry exiting from the headbox be controlled. In order to control the quantity and velocity of the slurry exiting from the headbox, the total head must be controlled since this determines the flow from the headbox for a given headbox slice opening. Since the level of stock within the headbox determines part of or all of the total head, it in turn becomes necessary to control the amount of stock which is delivered to the headbox, since the amount of stock flowing to the headbox controls the level of stock within the headbox. Control of this important variable, i.e. stock flow to a paper machine headbox, is the field to which this invention pertains.

b. Prior Art

Control of stock flow to a paper machine headbox is essentially a flow control problem. Thus, the prior art has resorted to the usual expedients employed in solving flow control problems. For example, the stock flow rate to the headbox may be measured by appropriate means, e.g. a magnetic flow meter, and compared to a set point representing the desired flow rate. If the actual stock flow rate deviates from the desired stock flow rate, appropriate control action is taken which, for example, might comprise either varying the speed of the stock pump or, alternatively, maintaining the stock pump at a constant speed and manipulating a flow control valve downstream of the stock pump. Although the prior has utilized this approach, certain disadvantages have been recognized. For example, in a large paper machine extremely high stock flow rates are encountered, e.g. flow rates as high as 25,000 gpm are not uncommon. Thus, if a flow control valve is placed in the main stock line, a small change in the valve position will result in a gross change in the stock flow rate. The resulting high gain between the stock flow control valve position and the total head creates at least two problems. First, commercially available valves are not infinitely adjustable, i.e. there is a minimum finite amount by which the position of such a valve can be changed. Although this amount is small and acceptable in most environments, the high flow rate and the high gain associated with the valve used as above precludes fine control of the stock flow because the change in flow rate associated with the minimum finite change which the valve can undergo is quite high. Second, because of the high gain between the stock flow valve position and the total head, the gain of the control loop positioning the valve must be very low (very high proportional band) in order to avoid instability. As is well known to those skilled in the art, a low control loop gain or high proportional band setting reduces the sensitivity of the control loop and obviates fine control. Thus, with this approach, it is difficult if not impossible to achieve fine control of the stock flow.

In an effort to circumvent the sensitivity problem created by locating a flow control valve directly in the stock line, the prior art utilized the approach of shunting the stock pump with a by-pass line and, rather than directly controlling the stock flow, controlled the stock flow by controlling the by-pass flow with a by-pass flow control valve. With this approach, a change in the position of the by-pass flow control valve resulted in a smaller change in the stock flow than would have occured with a valve inline with the stock pump. Thus, it was possible, under most circumstances, to utilize a lower proportional band or higher gain in the stock flow controller. However, even with this approach, when the by-pass flow control valve approached one of its operating limits, i.e. full open or full closed, any further small changes in the position of the by-pass flow control valve resulted in large changes of the stock flow thus once again creating a sensitivity problem. Further, if the by-pass flow control valve actually reached one of its operating limits, i.e. was actually either full open or full closed, further control of the stock flow was impossible without some manual manipulation of the speed of the stock pump.

In summary, all of the prior art approaches to solving the problem of controlling the stock flow to a paper machine headbox have been attended by certain disadvantages which are usually characterized by the necessity of reducing loop sensitivity (higher proportional band) in order to maintain acceptable stability. Through the use of my invention as hereinafter described, the operational disadvantages of prior art control systems have been eliminated.

SUMMARY OF THE INVENTION

My invention would be applicable to a paper machine headbox system which included a headbox, a stock pump, a main stock line from the stock pump which branches into a by-pass line shunting the main stock line or the main stock line and the stock pump and a headbox stock flow line through which stock may flow to the headbox. The headbox stock flow is primarily controlled by controlling the by-pass flow rate. However, means are further provided for controlling the main stock flow rate when the by-pass flow control valve reaches or approaches an operating limit. Initially, the main stock flow rate is established such that manipulation of the by-pass flow by use of a by-pass flow control valve can only vary the headbox stock flow over a narrow range. As such, a high loop gain may be utilized resulting in fine control of the headbox stock flow rate. When variation of the headbox stock flow rate is required and such variation is outside the aforementioned range, the main stock flow is altered which in effect, repositions the operating range of the by-pass flow control loop to encompass the new desired headbox stock flow rate.

Various approaches may be utilized to effect my invention. Thus, the aforementioned change in the main stock flow may be realized by using at least three approaches: altering the speed of the stock pump; manipulating a control valve downstream of the stock pump; or employing a second by-pass line from the main stock flow line around the stock pump.

With all of these approaches, various means may be utilized to generate main stock flow control signals. Of course, if these main stock flow control signals were allowed to continually alter the main stock flow rate, interaction between control of the main stock flow rate and the headbox stock flow rate would result. Thus, my invention further includes means for inhibiting control of the main stock flow in response to main stock flow control signals wherein this inhibiting action is regulated by a logic means. The logic means is generally responsive to the position of the by-pass flow control valve or the by-pass flow rate.

DETAILED DESCRIPTION OF THE INVENTION

Figure 1:
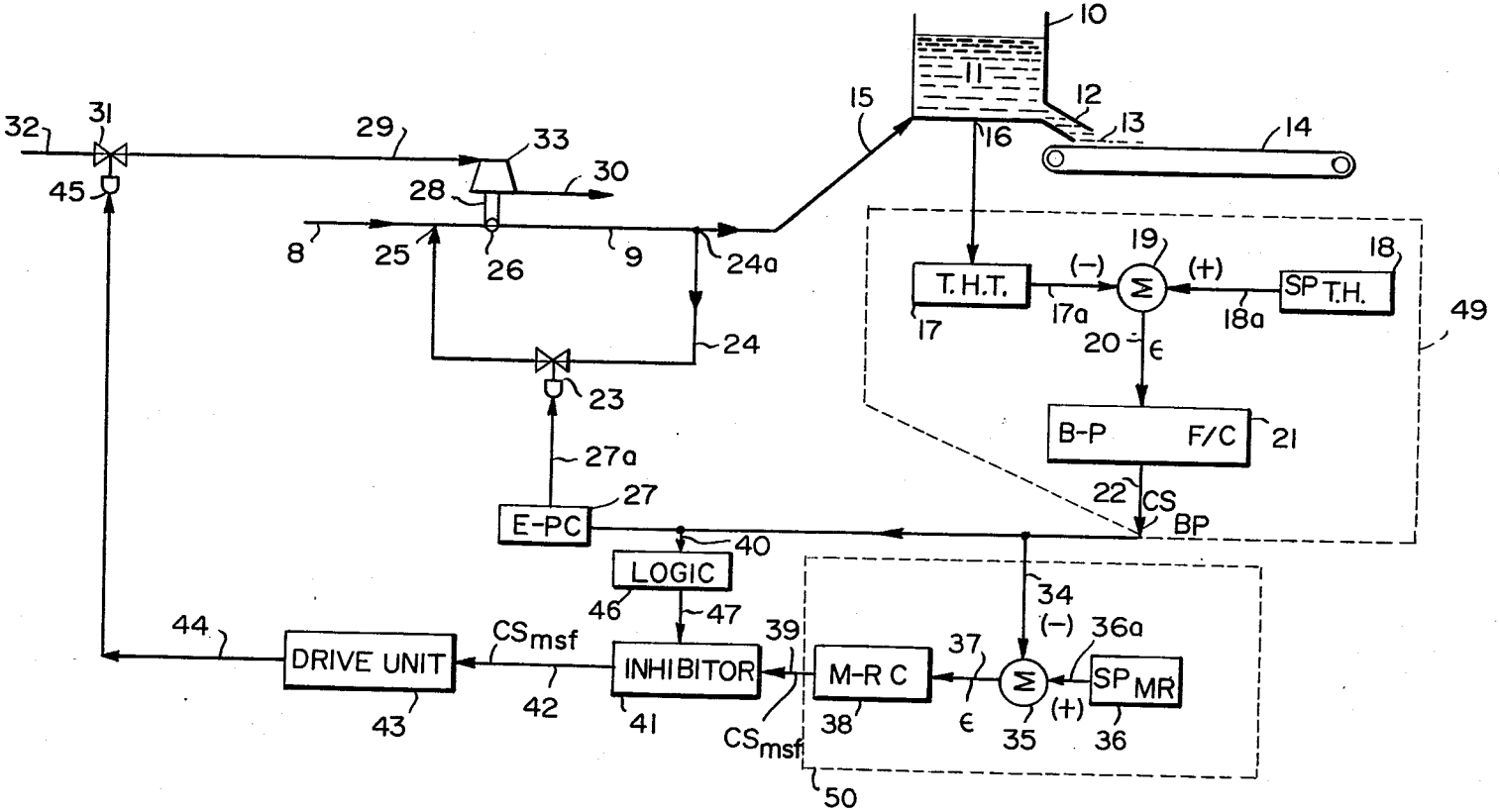
FIG. 1 is a schematic representation of a headbox system and one embodiment of my invention.

Referring to FIG. 1, there is depicted therein a paper machine headbox 10 containing a pulp slurry 11. The slurry 11 is discharged through a nozzel or slice 12 and is deposited on a moving foraminous wire 14 as at 13. As the deposited slurry is moved with the wire, water is drained therefrom and a paper web leaves the wire 14 for further processing. Not shown in FIG. 1 but known to those skilled in the papermaking art is the collection vessel or so-called white water pit into which water from the deposited slurry drains.

The slurry or stock 11 in the headbox 10 is supplied to the headbox by conduit 15 hereinafter referred to as the headbox stock flow line. As hereinbefore described, the process control problem relating to a paper machine headbox resides in the problem of insuring that the headbox stock flow to the headbox 10 through the headbox stock flow line 15 is equal to the stock discharged from the headbox 10 at the slice 12. When this condition is achieved, it will be manifested by the fact that the stock level within the headbox 10 will remain constant. The problem of maintaining a constant level is often compounded by the fact that the headbox, unlike the headbox shown in FIG. 1, may not open to the atmosphere but may be sealed at the top with an air pressure pad maintained on top of the stock. This procedure is utilized in order to achieve a greater total head and thus higher discharge rates from the headbox for a given level. Since the operation of my control system is applicable to either pressurized or non-pressurized headboxes, the headbox 10 in FIG. 1 is shown as being non-pressurized merely to simplify the description of the entire operation.

Most of the stock which is ultimately supplied to the headbox 10 is supplied by upstream operations not shown in FIG. 1. Suffice it to say that this stock is delivered to conduit 8. In actual operation, it would be common for the previously mentioned white water to be added to conduit 8. However, the closed circuit handling of white water is well known to the art, has no effect on the operation of my control system and thus has been omitted from FIG. 1. In conduit 8 there is located a stock pump 26 which is typically a fan pump. As shown in FIG. 1, the stock pump 26 may be driven through a mechanical connection 28 to a steam turbine 33. Steam is supplied to the turbine 33 by conduit 29 and discharged through conduit 30.

Conduit 9 is the discharge line from the stock pump 26 and is hereinafter referred to as the main stock line. Downstream of the stock pump 26, viz. at point 24*a*, the main stock line 9 branches into the headbox stock line 15 through which stock is supplied to the headbox 10 and conduit 24 which is a by-pass line. The by-pass line 24 shunts the stock pump 26 and returns the by-pass flow to the suction side of the stock pump 26 as at 25. Located in the by-pass line 24 is a by-pass flow control valve 23, the manipulation of which controls the by-pass flow which, in turn, controls the headbox stock flow.

Having described the basic hardware which comprises a paper machine headbox system, i.e. the stock pump 26, appropriate drive means for the stock pump and the headbox 10, the method and apparatus which comprises the preferred embodiment of my control system will now be described.

Broadly speaking, my invention contemplates the use of a first means for continuously controlling the headbox stock flow in conduit 15 by continuously regulating the by-pass flow. Additionally, there is utilized a second means which discontinuously controls the main stock flow in the main stock flow line 9.

In FIG. 1 the first means alluded to above comprises all the elements within the dotted line 49 as well as element 27 and the by-pass flow control valve 23. More specifically, the head or fluid pressure of the stock 11 in the headbox 10 is transmitted to a total head transmitter 17 through a conduit 16. The total head transmitter 17 is a pressure transmitter which is a commercially available transducer providing an output signal proportional to the pressure input. While this and most of the other transducers described herein may either be electronic or pneumatic, in the preferred embodiment of my invention I chose to utilize all electronic instruments. The output signal 17*a* from the total head transmitter 17 is compared at summing junction 19 with the output signal 18*a* from a set point station 18 wherein the set point signal 18*a* represents the desired total head or total head set point. If there is any difference between the total head signal 17*a* and the total head set point signal 18*a* an error signal 20 is generated. The error signal 20 is transmitted to a by-pass flow controller 21 which, in my preferred embodiment, is a two-action electronic analog controller. The output of the by-pass flow controller 21 is a by-pass flow control signal 22 which may be in the form of a current signal having a range of 10 to 50 milliamperes. The by-pass flow control signal 22 is transmitted to an electropneumatic convertor 27 wherein the 10 to 50 milliampere control signal is converted to a 3 to 15 psi pneumatic signal. The pneumatic control signal 27*a* is transmitted to the by-pass flow control valve 23 whereby the by-pass flow and thus the headbox stock flow is regulated.

Thus, if the headbox stock flow through the headbox stock flow line 15 varies it will be manifested by a change in level of the stock 11 in the headbox 10 which change in level will be detected by the total head transmitter 17. As a result, the output 17*a* of the total head transmitter 17 will change which will give rise to an error signal 20 assuming that the total head set point 18*a* has not also changed. The by-pass flow controller 21 will recognize the magnitude and polarity of the error signal 20 and generate an appropriate by-pass flow control signal 22 which, through the electro-pneumatic converter 27, will reposition the by-pass flow control valve 23 so as to re-establish the desired headbox stock flow.

So much of my control system as has now been described is known to the prior art and has heretofore been used to control the headbox stock flow by regulating the by-pass flow. However, to my knowledge, in all such prior art installations the main stock flow in the main stock flow line 9 downstream of the stock pump 26 has either been fixed at a maximum or only manually adjustable. That is to say, with reference to FIG. 1, it may be perceived that the main stock flow in line 9 determines both the maximum and minimum headbox stock flow through conduit 15 as well as the sensitivity of the headbox stock flow rate to changes in the by-pass flow control valve position. Thus, in the prior art, the main stock flow in line 9 was generally fixed and at a maximum. Thus, full stroking the by-pass flow control valve 23 changed the headbox stock flow in line 15 from a maximum to a minimum. That is to say, the headbox stock flow in the conduit 15 was very sensitive to small changes in the position of the by-pass flow control valve 23, particularly when the by-pass flow control valve 23 was nearly fully opened or fully closed. In an effort to alleviate the sensitivity problem thus created, some of the prior art control systems employed manual means for adjusting the main stock flow in line 9. A typical manner in which the prior art accomplished this result was to manually vary the speed to the turbine 33 which drives the stock pump 26. Thus, the stock pump 26 speed (and thus the main stock flow) might be manually adjusted to 50 percent of maximum in which case the sensitivity of the headbox stock flow in conduit 15 was reduced by a factor of 2, i.e. the headbox stock flow was only half as sensitive to changes in the position of the by-pass flow control valve. However, when it was desired to provide a headbox stock flow rate in excess of the prevailing main stock flow rate, it thus became necessary to manually increase the speed of the stock pump and thereby increase the main stock flow in the line 9. Although the prior art recognized the disadvantages in manually adjusting the main stock flow in the line 9 downstream of the stock pump 26, automatic control of the main stock flow in the line 9 was not attempted since it was thought that such control would conflict with the by-pass flow control loop and thus result in instability. The method and apparatus by which my invention provides automatic control of the main stock flow downstream of the stock pump while not resulting in instability will now be described.

In order to automatically control the main stock flow my invention first contemplates providing main stock flow control signals. However, in order to avoid the instability problem contemplated by the prior art, my control system inhibits any control action from taking place in response to the aforementioned main stock flow control signals except when the by-pass flow control loop is reaching an operating limit. In order to ascertain when this condition is occurring, i.e. when the by-pass flow control loop is reaching one of its operating limits, the inhibiting action is controlled from a logic unit. The information which the logic element operates upon, i.e. the input to the logic element, is a signal representative of either the position of the by-pass flow control valve or the by-pass flow rate but preferably the former. While numerous approaches may be utilized to obtain a signal which is representative of the position of the by-pass flow valve, in the preferred embodiments of my invention I choose to use the output of the by-pass flow controller 21. With this signal as an input, the logic element makes a logical determination as to whether or not control of the main stock flow in response to the main stock flow control signals should be inhibited.

Thus, referring once again to FIG. 1, the apparatus shown in the dotted block 50 provides main stock flow control signals. Using the particular approach shown in FIG. 1 and the particular apparatus within block 50, I tap signal 22 to obtain signal 34 which is equal to 22 and is representative of the position of the by-pass flow control valve 23 as demanded by the by-pass flow controller 21. Typically, this signal will be a current signal within the range of 10 to 50 milliamperes., Additionally, using a set point station 36, there is generated a set point 36*a* which I chose to set a level equal to a valve position of 50 percent. Thus, for the situation where the output of the bypass flow controller 21 varies over a range of 10 to 50 milliamperes corresponding to a valve position of 0 to 100 percent respectively, set point station 36 is adjusted to provide an output 36*a* of 30 milliamperes corresponding to a valve position of 50 percent and thus the set point signal 36*a* is referred to as a mid-range set point signal. The mid-range set point 36*a* is compared to the signal 34 which is related to or representative of the actual position of the by-pass flow control valve 23, the comparison being effected by summing junction 35. If signal 36a and 34 are not equal, the summing junction 35 provides an error signal 37 which, in my preferred embodiment, is transmitted to the mid-range controller 38 which may be a two action electronic analog controller. The output 39 of the midrange controller 38 is the main stock flow control signal which ultimately will be used to regulate the main stock flow in the line 9. The particular controller which I choose to use as the mid-range controller 38 is an electronic analog controller having a pulse duration output, i.e. a series of pulses, the duration and polarity of which determine the control action taken when these pulses are applied to an appropriate drive unit.

As previously explained, control action in response to the main stock flow control signals must be inhibited during certain times in order to avoid an unstable interaction between main stock flow control and by-pass flow control. Thus, in FIG. 1, I interpose an inhibitor element 41 between the output of the mid-range controller 38 and the drive unit 43.

In FIG. 1 it will be noted that the inhibitor 41 is controlled by a logic unit 46. The input 40 to the logic unit 46 is the output signal 22 from the by-pass flow controller 21. Since this signal is representative of the position of the bypass flow control valve 23, the logic unit 46 operates upon the signal to make a determination as to whether or not the main stock flow control signal 39 should be gated by the inhibitor 41 or allowed to pass through to the drive unit 43. The logical determination of the logic unit 46 is passed to the inhibitor 41 by signal 47.

When the logic unit 46 determines that the by-pass flow control valve 23 is reaching an operating limit, the signal 47 allows the main stock flow control signals 39 to pass through the inhibitor 41 and they are thus applied to the drive unit 43. The output 44 of the drive unit 43 repositions steam valve 31 through positioner 45. The repositioning of the steam valve 31 is such as to increase or decrease the speed of the stock pump 26 by providing more or less steam 29 to the turbine 33. Thus, through a change in speed of the stock pump 26, the main stock flow in line 9 is changed.

Summarizing the operation of the entire system as shown in FIG. 1, let it be assumed that, initially, the headbox system is in balance, i.e. the headbox stock flow 15 to the headbox 10 is equal to the stock discharge 13 and its equality is manifested by a constant level of the stock 11 in the headbox 10. So long as this condition exists, the by-pass flow 24 is held at a constant rate by maintaining the position of the by-pass flow control valve 23 at an appropriate point. Further, let it be assumed that the stock pump 26 is operating at only 50 percent of its maximum speed and that the headbox stock flow 15 to the headbox 10 is maintained, by the by-pass flow control system, at a level of 35 percent of the maximum headbox stock flow 15 which could be achieved if the stock pump 26 was running at maximum speed and the by-pass flow control valve was closed. Finally, by way of a disturbance, let it be assumed that the slice is opened in order to produce a heavier weight board with the result that there is an increase in the stock discharge 13 from the headbox 10 and the new stock discharge rate requires a headbox stock flow rate of 60 percent. Because of the aforementioned disturbance, the level of the stock 11 in the headbox will begin to fall. This change in level will be detected by the total head transmitter 17 causing a reduction in the output signal 17*a* which will give rise to a positive error signal 20 since there has been no change in the total head set point 18*a*. When the positive error signal 20 is applied to the by-pass flow controller 21 there will be a resulting increase in the by-pass flow control signal 22 from the controller 21 which will be converted by the electropneumatic converter 27 to an increased pressure signal 27*a* which is transmitted to the by-pass flow control valve 23. Since, in this embodiment, the by-pass flow control valve 23 must be an air-to-close valve, the increase in the pressure signal 27*a* will cause the by-pass flow control valve 23 to move toward its closed position. The result of this action will be a decrease in the by-pass flow and a resulting increase in the headbox stock flow. This control action will continue into one of two conditions occurs. First the by-pass flow control valve 23 may continue to close until it establishes a new and higher headbox stock flow rate 15 equal to the stock discharge rate 13 at which point the manipulation of the by-pass flow control valve 23 will cease. However, under the facts assumed above, this condition will never be reached because the stock pump 26 is only operating at 50 percent of its maximum speed but a headbox stock flow of 65 percent is required. Thus, as the position of the by-pass flow control valve 23 approaches its fully closed position (one operating limit) it will be apparent that the required headbox stock flow rate 15 is in excess of that which can be delivered at the present operating speed of the stock pump 26. Therefore, it will become necessary to increase the speed of the stock pump 26 or, more accurately, increase the main stock flow in the line 9. To effect this result, the remainder of the control system will take appropriate action to increase the speed of the stock pump 26 and thus increase the main stock flow in the line 9. Thus, when the by-pass flow control valve 23 closes to a pre-set point, e.g. 10 percent, the logic unit 46 will sense that the by-pass flow control valve 23 is reaching an operating limit and will allow the inhibitor 41 to pass appropriate main stock flow control signals 39 to increase the main stock flow by increasing the speed of the stock pump 26. As the main stock flow rate increases, the level of the stock 11 in the headbox 10 will stop falling and will start to rise. At this point, the by-pass flow control system 49 will start to open the by-pass flow control valve 23 and will continue to open as long as the main stock flow 15 continues to increase. However, when the by-pass flow control valve opens to a pre-set point, e.g. 40 percent open, the logic unit 46 will cause the inhibitor 41 to block any further main stock flow control signals 39 and thus the main stock flow 9 will stop increasing. The by-pass flow control system 49 will then manipulate the by-pass flow control valve 23 until the appropriate stock flow 5 is obtained at which point the entire system will again be in balance and the position of the by-pass flow control valve 23 will not be close to one of its operating limits.

Summarizing the operation of my control system as shown in the embodiment of FIG. 1 and described above, it will be apparent that the system essentially comprises means for providing by-pass flow control signals. Some signals from the flow control loop are cascaded onto a second control loop which operates discontinuously to adjust the main stock flow in line 9.

Since the operation of the second control loop, i.e. the control loop for controlling the main stock flow in the line 9, is discontinuous, and this discontinuous operation is implemented by the logic unit 46, a description of the logic unit 46 and the apparatus associated with that unit will now be given.

Figures 2, 2A:
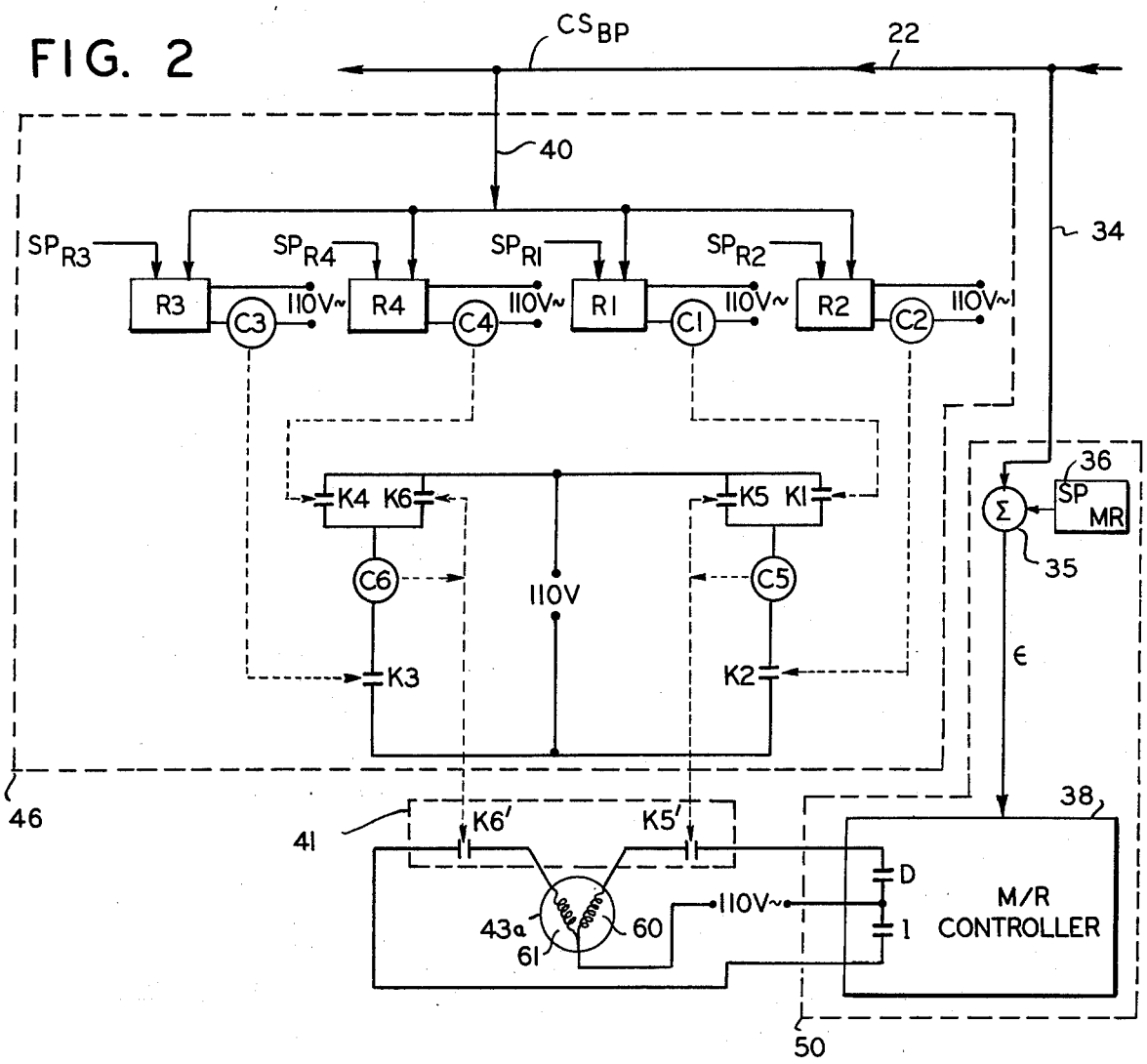
FIG. 2 is a detailed representation of some of the components shown in FIG. 1.
FIG. 2*a* is a truth table showing the logical operation of one of the components in the control system.

Referring to FIG. 2, certain of the apparatus elements shown in FIG. 1 are reproduced, viz. the logic element 46, the inhibitor 41, and the means for providing main stock flow control signals 50. Additionally, there is shown the motor 43*a* which is contained in the drive unit 43 of FIG. 1. The details and operation of the elements which comprise the logic unit 46 as well as the functional relation between the logic unit 46 and the other elements shown in FIG. 2 will now be described.

The embodiment of the logic element 46 as shown in FIG. 2 generally contemplates the use of a plurality of alarm relays. Generally speaking, such alarm relays, which are familiar to those skilled in the control art, are provided with a means for dialing in a particular set point. When a signal which is applied to such a relay exceeds the selected set point, either positively or negatively depending upon the type of relay employed, one or more coils are energized causing a contact within the alarm relay to either open or close. Thus, in FIG. 2, the signal 40 which is representative of the position of the by-pass flow control valve 23 is simultaneously applied to four such relays, R1 through R4. Additionally, each alarm relay R1 through R4 is provided with a set point signal $SP_{R1}$–$SP_{R4}$ respectively. Associated with each of the four alarm relays R1 through R4 are relay coils C1 through C4 respectively and associated with each coil C1 through C4 are output contacts K1 through K4 respectively.

Considering relays R1 and R2, these relays are selected such that their corresponding coils will be energized when the applied signal positively exceeds the set point signal. Thus, considering alarm relay R1, if and when signal 40 exceeds the set point signal $SP_{R1}$ associated with alarm R1, coil C1 will be energized. In turn, when coil C1 is energized, contact K1 will close and will remain closed while coil C1 is energized which, in turn, will remain energized while the applied signal 40 exceeds $SP_{R1}$. In contra-distinction to relays R1 and R2, relays R3 and R4 are selected such that their associated coils, C3 and C4, will be energized when the applied signal 40 is less than or equal to the applied set point signal $SP_{R3\ or\ SPR4}$. FIG. 2a summarizes this operation of the aforementioned relays, RI–R4, in the form of a truth table.

Considering now the operation of all the elements which comprise the logic element 46, the various set points $SP_{R1}$–$SP_{R4}$ are set at the following values expressed as a percentage of signal 40:

$SP_{R1}$ = 90 percent
$SP_{R2}$ = 60 percent
$SP_{R3}$ = 40 percent
$SP_{R4}$ = 10 percent With the above values for the various relay set points in mind, the following operation will result. Assume that initially signal 40 is 50 percent of its maximum value, i.e. a signal representative of the by-pass flow control valve position of 50 percent. Next, assume that the valve of the signal 40 commences to increase i.e. the valve is opening. When the value of the signal 40 exceeds 60 percent, relay R2 will energize coil C2 causing contact K2 to close. Next, assume that the signal 40 continues to increase and ultimately exceeds the value of 90 percent at which time relay R1 will energize coil C1 thus closing contact K1. It will now be observed that, in FIG. 2, contacts K1 and K2 are in series with a coil C5 and across the entire series circuit there is an applied voltage. Thus, when contacts K1 and K2 close, the voltage is applied across coil C5 thus energizing coil C5. Coil C5 has associated with it two output contacts K5 and K5′ both of which close when coil C5 is energized. Since contact K5 is wired in parallel with contact K1, it will be appreciated that K5 operates as a holding contact to maintain the series circuit once coil C5 has been energized. Therefore, once contacts K1 and K2 are closed, coil C5 will be energized closing contacts K5 and K5′. When K5 is closed the circuit will be maintained even though K1 opens.

As may be noted, contact K5′ is wired in series with one leg 60 of the split phase motor 43*a* as well as one of the output contacts of the mid-range controller 38, viz. the output contact "D" of the controller which generates decrease control signals.

In this embodiment of my invention main stock flow control signals or pulses are usually being generated by the mid-range controller 38. As such, assuming that signal 34, which is equal to signal 40 and representative of the position of the by-pass flow control valve 23, is greater than the mid-range set point 36*a*, the mid-range controller 38 will be generating decrease main stock flow control signals 39 by the mechanism of periodically closing the contact D within the mid-range controller 38. Once the contact K5′ is closed, the decrease main stock flow control signals generated by contact D will result in a potential being applied across leg 60 of the drive motor 43a which will cause the drive unit 43 to move in the direction of decreasing the steam flow to the turbine 33 resulting in a decrease in the speed of stock pump 26. This action will continue until the position of the by-pass flow control valve 23 is once again within its operating limits which condition will be manifested by an opening of the contact K5′ preventing further decrease action.

In the above example, it had been assumed that the signal 40 was initially at a 50 percent value and then commenced to increase to some value in excess of 90 percent. Alternatively, the situation will now be considered wherein the signal 40 is initially at a value of 50 percent and commences to decrease, i.e. the situation where the by-pass flow control valve is closing in response to the output of the by-pass flow controller 21. As the signal 40 decreases and reaches a value of 40 percent, relay R3 will energize coil C3 which in turn will close contact K3. Assuming signal 40 continues to decrease, when signal 40 reaches a value of 10 percent relay R4 will energize coil C4 which in turn will close contact K4. Contacts K4 and K3 being closed, coil C6 and will be energized, the result of which will be contacts K6 and K6′ will be closed. Contact K6′ is wired in series with the increasing leg 61 of the split phase motor 43*a* and the increase contact I in the mid-range controller 38. Thus, since the signal 34, which is equal to the signal 40 and representative of the position of the by-pass flow control valve 23, is at a value of 10 percent or less, the signal 34 will be less than the value of the signal 36a which is the midrange set point and equal to 50 percent. Therefore, the increase or I contact in the mid-range controller 38 will be closing and, since contact K6′ is closed, the control information represented by the closing of contact I will be transmitted to the split phase motor 43*a* causing drive unit 43 to move in a direction such as to open the value 31 allowing more steam to go to the turbine 33 which in turn increases the speed of the stock pump 26. As the speed of the stock pump 26 increases, the main stock flow in the line 9 increases causing a higher headbox stock flow and thus a change in level in the headbox which, when detected by the by-pass flow control loop, will eventually cause the by-pass flow control valve 23 to start opening. This action will continue until the position of the by-pass flow control valve exceeds 40 percent at which point relay R3 will de-energize coil C3 opening contact K3. When contact K3 is opened coil C6 will be de-energized opening contact K6′ with the result that no further increase pulses will reach the drive unit motor 43*a*.

Figure 3:
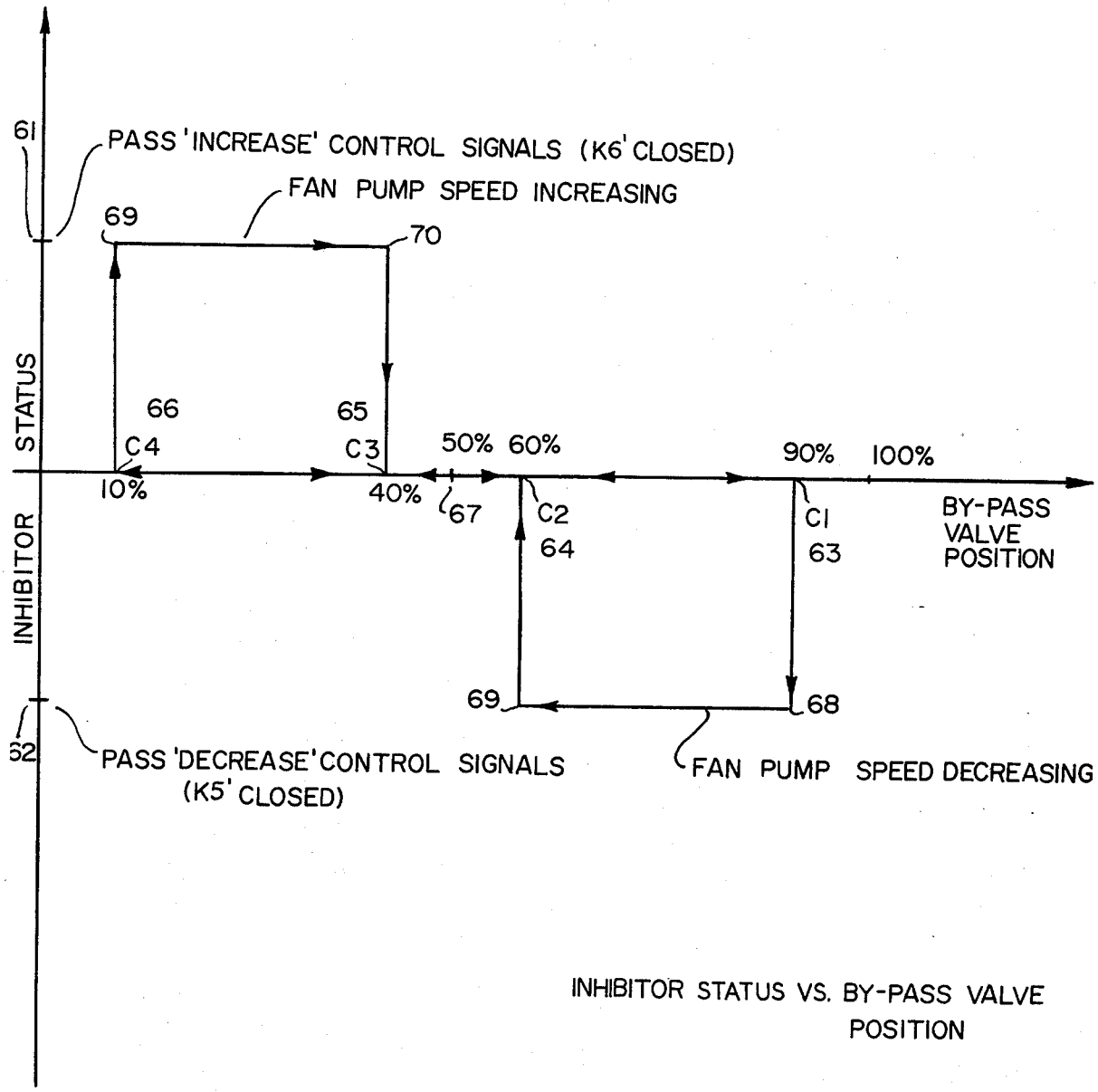
FIG. 3 is a graphical representation of the operation of a logic element in my control system.

The operation of the logic unit 46 as shown in FIG. 2 is graphically represented in FIG. 3 of the drawings. Thus, referring to the graph in FIG. 3, the abscissa represents the position of the by-pass flow control valve while the ordinate represents the status of the inhibit means, i.e. whether the inhibit means will inhibit all signals, pass only increase signals or pass only decrease signals. More specifically, point 61 on the ordinate indicates that the inhibitor 41 in FIG. 1 is in such a state as to pass increase control signals, i.e. referring to FIG. 2, the condition when contact K6′ is closed. Alternatively, point 62 on the ordinate of the graph shown in FIG. 3 represents the condition when the inhibitor 41 in FIG. 1 will pass decrease control signals, i.e. referring to FIG. 2, the condition when contact K5′ is closed.

Referring to points on the abscissa, four points may conveniently be defined which points correspond to the various states which the logic means may assume. I define these four points as follows:

| Point No. | Logic State |
|---|---|
| 63 | Lower |
| 64 | Lower enable |
| 65 | Raise enable |
| 66 | Raise |

It will be appreciated that the four points referred to above 63–66 correspond to the positions of the by-pass flow control valve which will result in energizing coils C1 through C4 respectively as shown in FIG. 2. Thus, once again assume that the by-pass flow control valve is at its 50 percent position, i.e. it is half open, which condition is represented in FIG. 3 by the point 67. Assuming further that the by-pass flow control valve commences to open in response to control signals received from the by-pass flow control means 49, this action will be graphically represented in FIG. 3 by movement along the abscissa from point 67 to the right. At point 64 coil C2 will be energized (as heretofore described) causing the logic unit 46 to assume a lower enable state, i.e. referring to FIG. 2, contact K2 is closed and the logic unit 46 is ready to place the inhibitor 41 is a condition to pass decrease control signals as soon as contact K1 is closed. If the by-pass flow control valve continues to open, point 63 will be reached causing the logic unit 46 to assume a lower state, i.e. referring to FIG. 2, coil C1 will be energized closing contact K1 which in turn will energize coil C5. Once coil C5 has been energized contact K5′ will be closed thus permitting decrease (lower) signals, from the means for generating MSFCS 50, to cause corrective action, i.e. decrease the speed of the stock pump 26. In FIG. 3, this is represented by the change in status of the inhibit means from the point 63 on the abscissa to the point 68. During the interval 68 to 69 as shown in FIG. 3, the stock pump speed will be decreasing in response in decrease main stock flow control signals passed by the inhibitor 41. This action will continue until point 69 is reached at which point coil C2 in FIG. 2 will be de-energized and the inhibitor 41 will once again block all main stock flow control signals. This action is manifested by the line 69–94 wherein the inhibit means changes status. Once point 64 has been reached, control of the headbox stock flow 15 is responsive only to the output of the by-pass flow control means assuming the position of the by-pass flow control valve stays within 10 to 90 percent of its operating range.

The other half of the graph shown in FIG. 3 represents the condition which exists when the by-pass flow control valve 23 is closing. Thus, assuming that the by-pass flow control valve is initially at a position corresponding to point 67, i.e. it is 50 percent open, as the valve starts to close point 65 will be reached at which point coil C3 will be energized closing contact K3 as shown in FIG. 2. At this point, the logic unit 46 is said to be in a raise enable state, i.e. if coil C4 is thereafter energized a raised state will be achieved and the inhibitor will be allowed to pass increase control signals. In FIG. 3, assuming the by-pass flow control valve continues to close, point 66 will be reached at which point coil C4 will be energized and the logic unit will assume a raise state. This is manifested in FIG. 3, by the line 66–69 indicating that the inhibitor status has altered to permit increase main stock flow control signals to pass. This status of the inhibitor will be maintained and the stock pump speed will increase as depicted by the line 69–70. Of course, in response to the stock pump speed increasing, the by-pass flow control valve will be opening and both conditions will continue to occur, i.e. the stock pump speed will continue to increase and the by-pass flow control valve 23 will continue to open, until point 70 is reached, at which point coil C3 will be de-energized changing the inhibitor status to a condition of blocking all control signals from the main stock flow control means 50. This status change is reflected by the line 70–65.

As previously pointed out, my invention contemplates that there will be means provided for generating main stock flow control signals. Such means were broadly referred to in FIG. 1 by the reference number 50 and the apparatus shown within the dotted block 50 in FIG. 1. While this apparatus is my preferred method of generating main stock flow control signals, there will now be described an alternative method and apparatus for generating main stock flow control signals.

Figure 4:
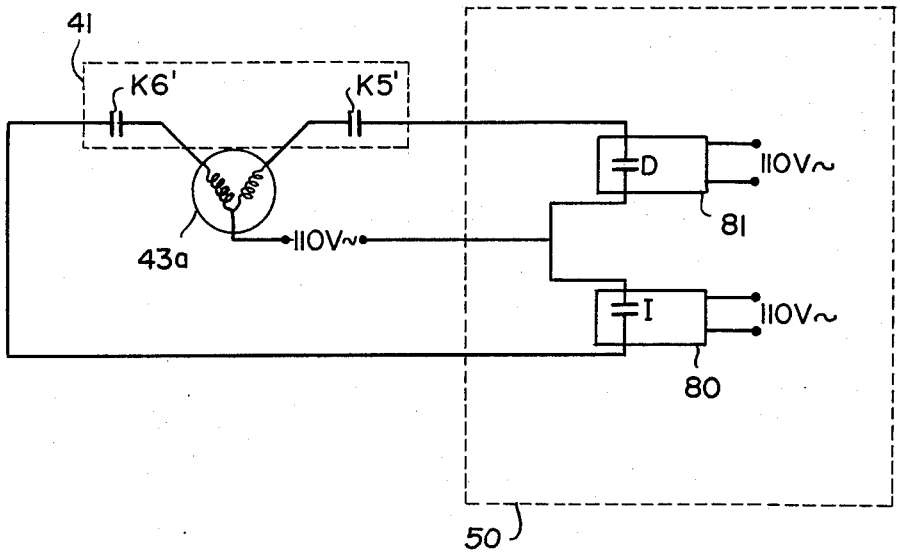
FIG. 4 is a schematic, in block diagram form, of another embodiment of one part of my control system.

Whereas the method and apparatus shown in FIG. 1 for generating main stock flow control signals was dependent upon or related to the position of the by-pass flow control valve 23, the method and apparatus shown in FIG. 4 is unrelated to the position of the by-pass flow control valve. In FIG. 4, as a means for providing main stock flow control signals 50, there is provided two motor driven, cam operated contacts 80 and 81. These units are commercially available and generally comprise a synchronous motor with a cam mounted on the motor shaft and a SPST contact operated by a cam follower. As shown in FIG. 4, one of the contacts is denominated by the letter I. In this embodiment of the means for providing main stock flow control signals, the motors operate continuously and the output contacts D and I are appropriately wired to the split phase motor 43A of the drive unit 43 with the inhibitor 41 interposed between each of the contacts D and I. Thus, the two contacts D and I within the motor operated switches 80 and 81 generate signals whose magnitude is unrelated to the position of the by-pass flow control valve 23 as contra-distinguished from the means 50 shown in FIG. 1 wherein the magnitude of the main stock flow control signals was related to the position of the by-pass flow control valve 23. In FIG. 4, the operation of the inhibitor 41 would be responsive to the logic unit (not shown) as previously described.

With reference to all the embodiments heretofore shown for providing main stock flow control signals, it may be noted that each embodiment contemplates a method and apparatus for providing main stock flow control signals in the form of a series of pulses whose duration and polarity may or may not be related to the position of the by-pass flow control valve. It should be appreciated, however, that the main stock flow control signals do not have to be in the form of a series of pulses but may take some other form, e.g. a continuous signal of varying magnitude and/or polarity.

It may be observed that all the embodiments of my invention heretofore described have contemplated that the main stock flow rate has been varied or controlled by altering the speed of the stock pump 26. However, as previously alluded to, my invention broadly contemplates controlling the main stock flow in response to the main stock flow control signals which signals are allowed to effect control action only when the by-pass flow control valve 23 reaches or approaches an operating limit. Thus, altering the speed of the stock pump 26 is but one technique for controlling the main stock flow. There will now be described two other embodiments of my invention wherein the main stock flow is controlled by mechanisms other than varying the speed of the stock pump. In the following description of two of the mechanisms for controlling the main stock flow, it will be assumed that main stock flow control signals have been provided by one of the methods or apparatus arrangements previously described for that purpose or an equivalent thereof.

Figure 6:
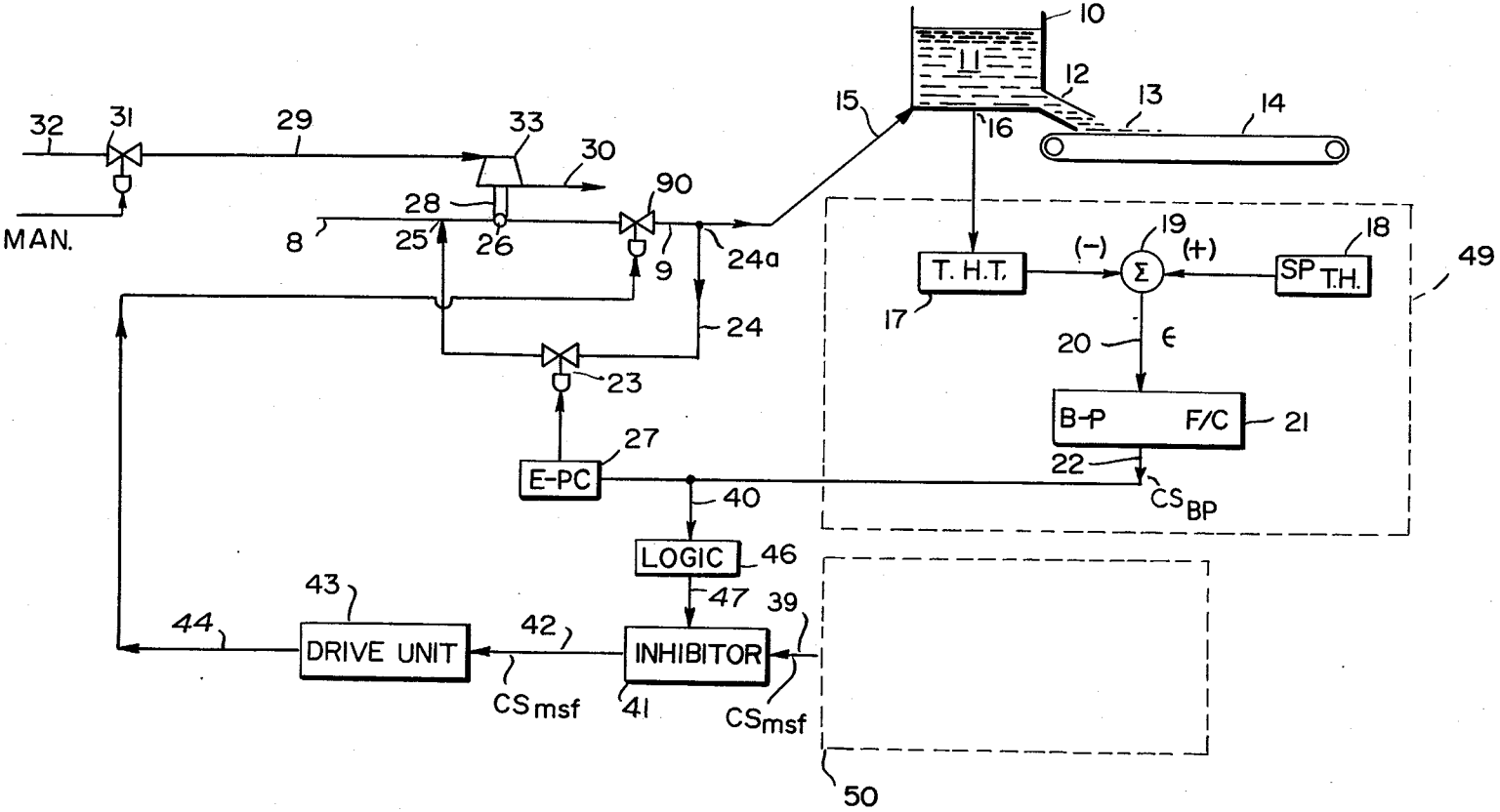
FIG. 6 is a schematic representation of a paper machine headbox system including another embodiment of my control system.

Shown in FIG. 6 are the basic elements of a paper machine headbox system as described in FIG. 1 with the same reference numbers being used in FIG. 6 as was used in FIG. 1 for corresponding elements. However, with respect to the stock flow system, it will be apparent that there are some changes in apparatus arrangement. For example, although the steam supply 29 to the stock pump turbine 33 is controlled by a valve 31, the valve is not actuated by a signal generated within my control system but by some externally obtained means. Once the steam flow 29 to the turbine 33 has been established by a setting of the valve 31, my control system will proceed to perform a headbox stock flow control function within the limitation imposed by the setting of the valve 31. Thus, in the embodiment of my invention shown in FIG. 6, the headbox stock flow 15 is normally controlled by controlling the by-pass flow 24 through a manipulation of the by-pass flow control valve 23. The by-pass flow control valve 23 moves in response to signals generated by the by-pass flow control means 49 and an appropriate transducer interposed therebetween, e.g. an electropneumatic convertor 27. If and when conditions should be such that the position of the by-pass flow control valve 23 approaches an operating limit, it will be repositioned by altering the main stock flow in the line 9. The manner in which this main stock flow alteration or change is effected in the embodiment of FIG. 6 will now be described.

Rather than altering the main stock flow by varying the speed of the stock pump 26 (as with the technique used in the embodiment of FIG. 1), the embodiment shown in FIG. 6 utilizes a control valve 90 located downstream of the stock pump 26. The main stock flow control signals which were heretofore used to alter the speed of the stock pump 26 when the by-pass flow control valve 23 approached an operating limit are now used to manipulate the valve 90. This result is effected in substantially the same manner as that previously described, i.e. a means for providing main stock flow control signals 50 is employed with the resulting signals used as an input to inhibitor 41 which, in response to direction from the logic unit 46, will either: (1) block all signals; (2) pass only increase signals; or (3) pass only decrease signals. The relationship between the control of valve 90 and the position of the by-pass flow control valve 23 is analogous to that which existed in the embodiment of FIG. 1 as between the turbine steam flow valve 31 and the position of the by-pass flow control valve 23. That is to say, if the logic unit 46 utilizes the same set points to establish its various states, i.e. raise, raise enable, lower, or lower enable, when the by-pass flow control valve 23 is 90 percent open, decrease or lower signals will be passed by the inhibitor from the main stock flow control means 50 which signals will cause the valve 90 to decrease or close. The result of closing the valve 90 will be a decrease in the main stock flow through the line 9 which will cause the by-pass flow control valve 23 to close. Alternatively, should the by-pass flow control valve 23 close to its 10 percent position, the inhibitor will pass open or increase signals from the main stock flow control means 50 to the valve 90 which will cause the valve 90 to open. As the valve opens, the stock flow therethrough will increase which action will cause an opening of the by-pass flow control valve 23. Of course, similar to the embodiment of FIG. 1, appropriate manipulation of the valve 90 will continue until the position of the by-pass flow control valve is re-established within the point previously referred to as either the raise enable point or the lower enable point.

Figure 7:
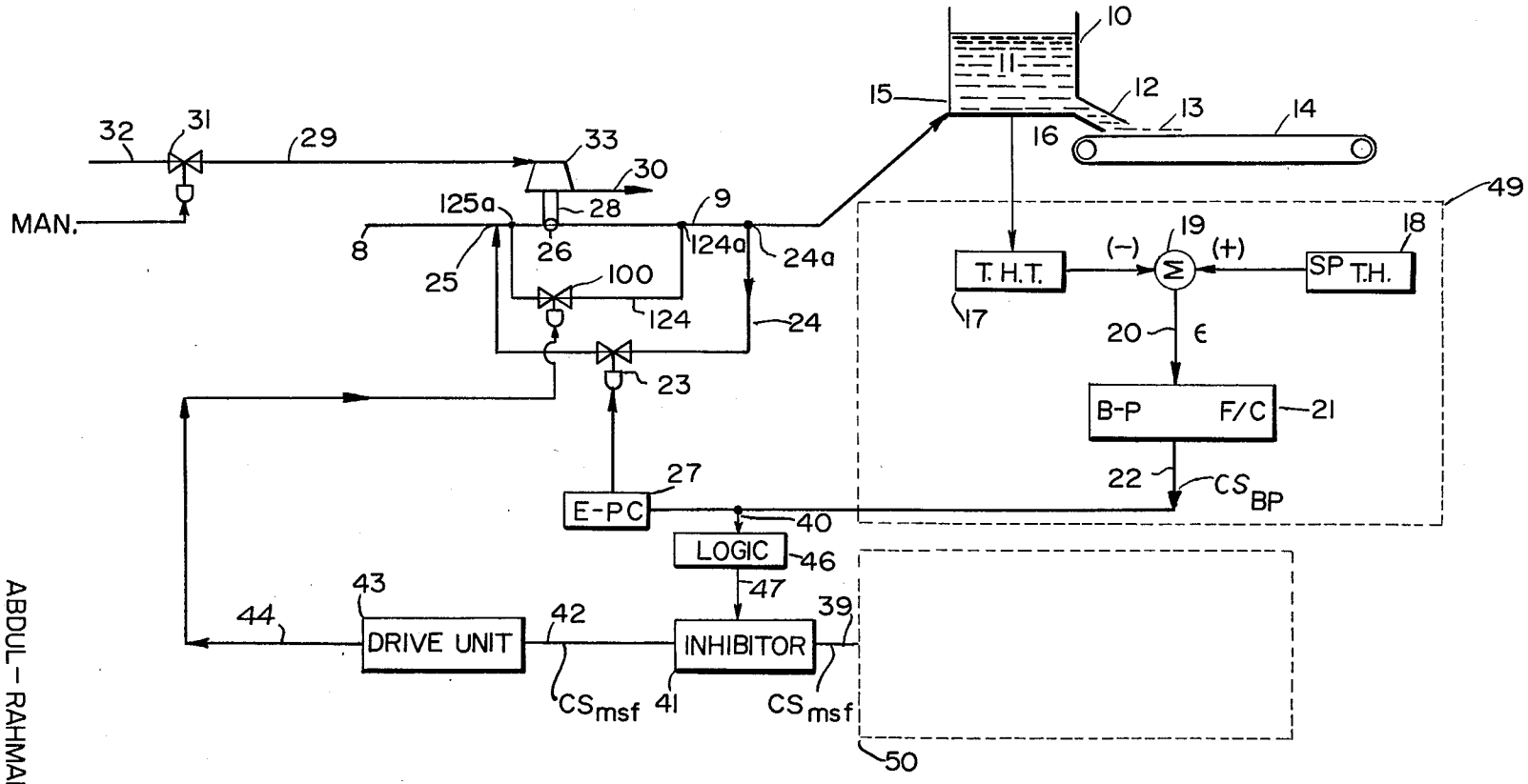
FIG. 7 is a schematic representation of a paper machine headbox system including another embodiment of my control system.

The embodiment of my invention shown in FIG. 7 is similar to that which is shown in FIG. 6 in that the speed of the stock pump 26 is fixed by an externally obtained signal applied to the steam flow control valve 31. The embodiment of FIG. 7 differs from the embodiment of FIG. 6 in that the main stock flow is regulated not by a valve in the line 9 but by utilizing a second by-pass flow loop 124 which shunts the stock pump 26 and may be located either interiorly or exteriorly of the by-pass line 24. By way of example, the embodiment of FIG. 7 shows the second by-pass line 124 located interiorly of the by-pass line 24. The flow in the interior by-pass loop 124 is controlled by a second by-pass flow control valve 100 which, as will be described, is responsive to the main stock flow control signals 39 from the main stock flow control means 50.

As was the case with the embodiments of my invention shown in FIGS. 1 and 6, the embodiment of FIG. 7 generally controls the headbox stock flow by controlling the by-pass flow through manipulation of the by-pass flow control valve 23. When the by-pass flow control valve 23 approaches an operating limit, e.g. either 10 or 90 percent of its full stroke, the logic unit 46 allows the inhibitor 41 to pass main stock flow control signals 39 which, in the embodiment of FIG. 7, are used to manipulate the second by-pass flow control valve 100 and thus flow in the second by-pass flow line 124. Since the second by-pass flow line 124 is parallel to the by-pass flow line 24, changes in the flow through the second by-pass flow line 134 will alter the flow in the main stock line 9. As such, manipulation of the second by-pass flow control valve 100 in response to the main stock flow control signals 39 will alter the main stock flow in the line 9 and the headbox stock flow in the line 15 and will thus cause the by-pass flow control valve 23 to be repositioned in a manner analogous to the operation of the embodiment shown in FIGS. 1 and 6. However, it should be noted that in the other embodiments of my invention the valve which was utilized to control the main stock flow was moved towards its closed position when the by-pass flow control valve 23 had opened too far, e.g. to its 90 percent point. Similarly, in the other embodiments of my invention, the valve utilized to control the main stock flow was moved towards its opened position when the by-pass flow control valve 23 had closed too far, e.g. closed to its 10 percent point. However, with the embodiment of FIG. 7, it will be appreciated that the second by-pass flow control valve 100 must open, rather than close, when the by-pass flow control valve 23 has opened too far. Alternatively, when the by-pass flow control valve 23 has closed too far, the second by-pass flow control valve 100 must close rather than open. Thus, when the embodiment of FIG. 7 is utilized, the main stock flow control is reversed compared to the embodiments of FIGS. 1 and 6. This change in control action can be easily achieved, e.g. by reversing the wiring to the legs 60 and 61 of the above motor 43*a*.

Figure 8:
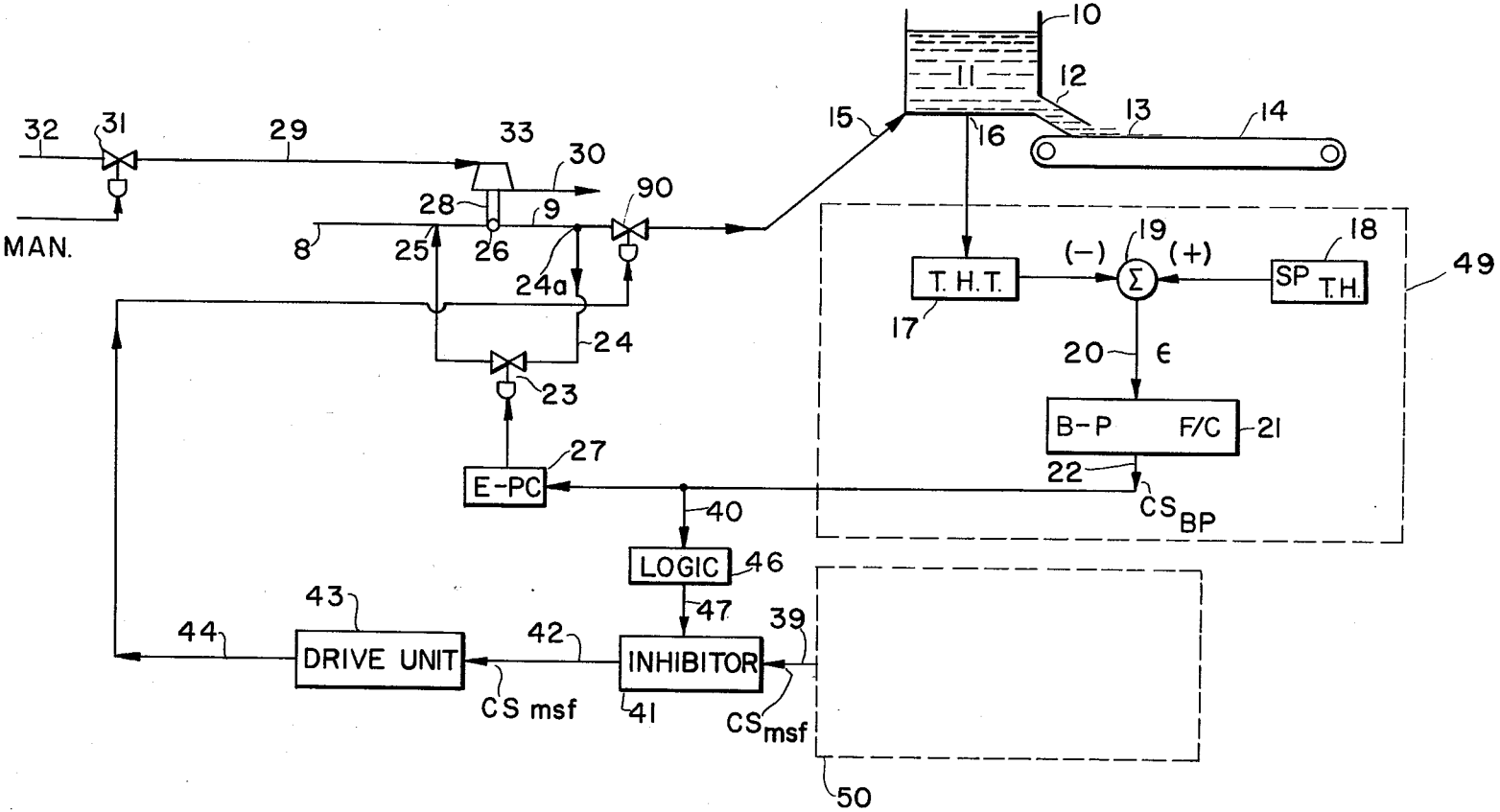
FIG. 8 is a schematic representation of a paper machine headbox system including another embodiment of my control system.

The embodiment of my invention shown in FIG. 8 is similar to the previous embodiments of my invention in that the by-pass line 24 shunts the main stock line 9 to the suction side of the stock pump 26. However, as distinguished from the embodiment of my invention as shown in FIG. 6 wherein the main stock flow control valve is located in the main stock flow line 9, the embodiment of FIG. 8 utilizes a main stock flow control valve 90 which is located in the headbox stock flow line 15.

In operation, the embodiment of FIG. 8 operates in a manner similar to the operation of the embodiment shown in FIG. 6. That is to say, the headbox stock flow rate through the line 15 is a continuously controlled by controlling the by-pass flow through the by-pass line 24. Control of the by-pass flow is achieved by manipulation of the by-pass flow valve of 23 in response to by-pass flow control signals provided by the by-pass flow control means 49. Should the by-pass flow control valve 23 reach or approach an operating limit, i.e. either full open or full closed, this condition would be detected by the logic unit 46 and, responsive to the position of the by-pass flow control valve 23, the logic 46 would allow the inhibitor 41 to pass main stock flow control signals. In the embodiment of FIG. 8, the main stock flow control signals 39 would actuate the main stock full control valve 90 in such a manner as to cause the by-pass flow control valve 23 to return to its operating range. For example, if the by-pass flow control valve 23 was approaching its fully closed position, the means 50 for supplying main stock flow control signals would provide signals to the main stock flow control valve 90 which would cause valve 90 to open. The opening of the main stock flow control valve 90 would allow more stock to pass through line 15 to headbox 10. The flow rate of stock through the line 15 would be increased by continually opening the main stock flow control valve 90 until the by-pass flow control valve was repositioned at some position distant from the fully closed position. Once the by-pass flow control valve 23 had been repositioned to a preset point, e.g. 40 percent open, the logic unit 46 would cause the inhibitor 41 to block main stock flow control signals 39 and the main stock flow control valve 90 would remain at its last position. Thereafter, stock flow through the line 15 to the headbox 10 would be controlled by manipulation of the by-pass flow control valve 23. Of course, the system would operate in a similar but opposite fashion should the by-pass flow control valve 23 approach its fully open position.

Figure 9:
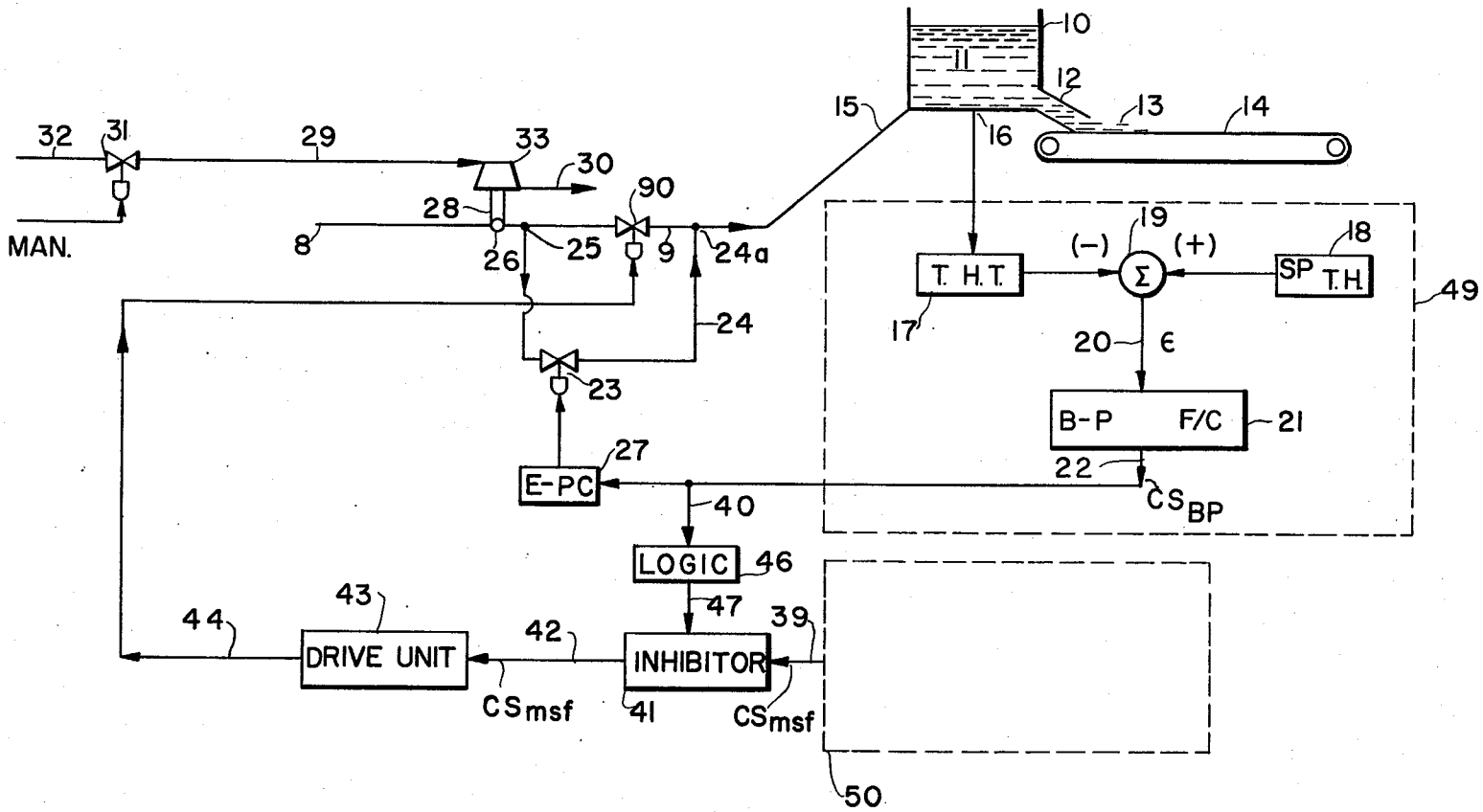
FIG. 9 is a schematic representation of a paper machine headbox system including another embodiment of my control system.

The embodiment of my invention is shown in FIG. 9 differs from all previous embodiments in that the by-pass line 24 does not shunt the stock pump 26, i.e. at point 24A, the main stock flow line 9 branches into a headbox stock flow line 15 and a by-pass line 24 which shunts the main stock flow line 9 to point 25 which is on the discharge side of the stock pump 26. Of course, it will be perceived that with this approach the flow through the by-pass line 24 is opposite from that which occurred in all previous embodiments of my invention.

In the embodiment of FIG. 9, the means for controlling the main stock flow is the main stock flow control valve 90. As in the case of the other embodiments of my invention, the stock flow rate to the headbox 10 is normally controlled by manipulation of the by-pass valve 23 in response to by-pass flow control signals provided by by-pass flow control means 49 previously described. If the by-pass flow control valve 23 reaches or approaches an operating limit, i.e. either full open or full closed, the logic-inhibit means 46–41, which is responsive to the position of the by-pass flow control valve 23, will permit main stock flow control signals 39 to pass to the main stock flow control valve 90 and thus alter the main stock flow in the line 9 such as to reposition the by-pass flow control valve 23 within its operating range. It should be noted, however, that the operation of the main stock flow control valve 90 as shown in FIG. 9 would be reversed as compared to the operation of the main stock flow control valve 90 in FIG. 8. Thus, in the embodiment of FIG. 9, if the by-pass flow control valve 23 was approaching its fully open position, the appropriate corrective action to return the by-pass flow control valve 23 to its operating range would be to open the main stock flow control valve 90. Similarly, if the by-pass flow control valve 23 were approaching its fully closed position, the appropriate corrective action would be to move the main stock flow control valve 90 towards its closed position. To achieve this reversed operation (as compared to the embodiment of FIG. 8) any one of a number of changes could be made, all of which are within the capabilities of those skilled in the art, e.g. reversing the output wiring from the means 50 for supplying main stock flow control signals.

Figure 5:
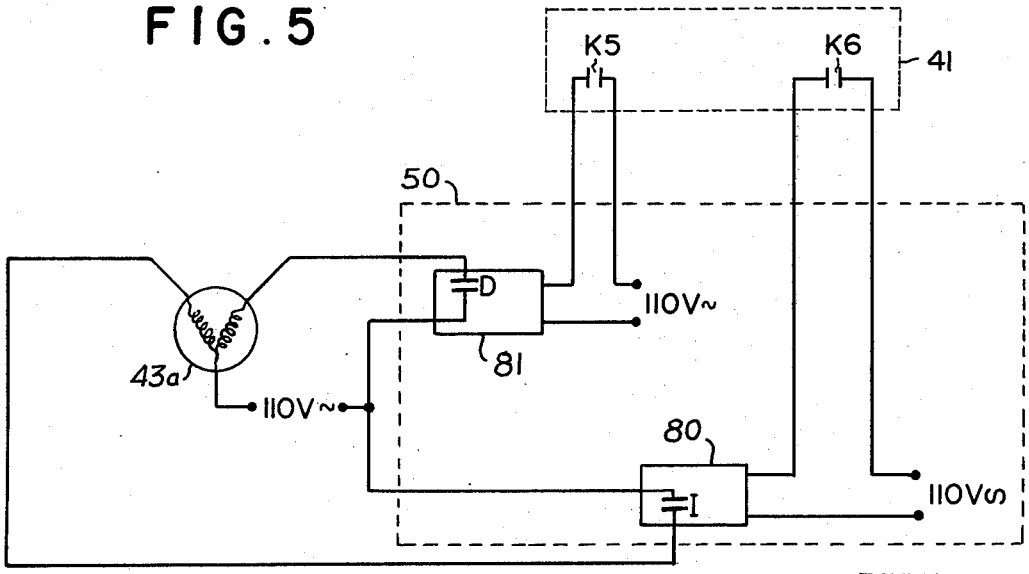
FIG. 5 is a schematic, in block diagram form, of another embodiment of one part of my control system.

While numerous embodiments of my invention have heretofore been described, it will be evident that still other equivalent embodiments will be perceived by those skilled in the art. For example, with respect to the means for generating main stock flow control signals, it may be noted that in all the embodiments heretofore disclosed the inhibitor inhibited transmission of such signals from the main stock flow control means to an apparatus which would be actuated by these signals. However, a clear equivalent of this approach would be to utilize the contacts within the inhibitor to actuate the main stock flow control means which means would always be directly connected to an actuating unit. With this approach, an example of which is shown in FIG. 5, generation of the main stock flow control signals (by motor operated contacts 80 and 81) would be inhibited rather than inhibiting the transmission of control signals to an actuating unit.

An alternate approach for the practice of my method would be to utilize a digital computer to perform any, if not all, of the functions disclosed herein. Thus, if should be realized that the apparatus arrangements disclosed herein are only exemplary enumerations of my invention.

Having heretofore described, by way of example and not by way of limitation, some of the embodiments of my invention, I define my invention to be within the scope of the appended claims.

I claim:

1. In a paper machine headbox system including a headbox, a stock pump, a main stock line from said stock pump which branches into a by-pass line which 28. The apparatus of claim 24 wherein said second means provides main stock flow control signals which are a series of pulses, the magnitude of said pulses being unrelated to the position of said mechanical flow control element means.

29. The apparatus of claim 28 wherein said logic-inhibit means inhibits the transmission of said pulses from said second means to said third means.

30. The apparatus of claim 28 wherein said logic-inhibit means inhibits said second means by de-energizing said second means.

31. In a paper machine headbox system including a headbox, a stock pump, a main stock line from said stock pump which branches into a by-pass line shunting said main stock line and a headbox stock flow line connecting said headbox with said main stock line, and a by-pass flow control valve having a finite flow control range in said by-pass line, the method of controlling the stock flow in said headbox stock flow line which comprises:

a. obtaining a first signal proportional to the differential between total stock flow to said headbox and total stock flow therefrom;

b. manipulating said by-pass valve in response to said first signal and in a manner to eliminate said differential;

c. monitoring said by-pass valve control within said finite flow control range and generating second and third signals proportional thereto;

d. manipulating the stock flow rate in said main stock line in response to said second signal and in a manner to maintain said by-pass valve within an effective portion of said finite flow control range; and, e. inhibiting said main stock flow rate manipulation response to said second signal by said third signal, said third signal allowing said second signal manipulation of said main stock line flow rate only when said by-pass valve control status exceeds predetermined limits within said finite control range.

32. The method of claim 31 wherein said first signal is obtained from a direct measurement of the total pressure head within said headbox.

33. In a paper machine headbox system including a headbox, a stock pump, a main stock line from said stock pump which branches into a by-pass line shunting said stock pump with a by-pass flow control valve therein and a headbox stock flow line through which stock may flow from said main stock line to said headbox, the method of automatic controlling the stock flow in said headbox stock flow line which comprises:

a. obtaining by-pass flow control signals b. controlling the by-pass flow by manipulating said by-pass flow control valve in response to the by-pass flow control signals;

c. obtaining main stock flow control signals;

d. controlling the main stock flow in response to the main stock flow control signals;

e. obtaining a first signal representative of the position of said by-pass control valve; and f. inhibiting control of the main stock flow in response to said first signal until the position of said by-pass flow control valve exceeds predetermined limits.

34. The method of claim 32 wherein said first signal differential is obtained by comparing the value of said total pressure head to a predetermined set-point.

* * * * *

UNITED STATES PATENT OFFICE

CERTIFICATE OF CORRECTION

PATENT NO. : 3,981,767

DATED : September 21, 1976

INVENTOR(S) : Abdul-Rahman A. Al-Shaikh

It is certified that error appears in the above-identified patent and that said Letters Patent are hereby corrected as shown below:

Column 9, line 22, "SP" second occurrence should be written in bold type. Column 10, line 29, delete "and"; line 31, "increasing" should be --increase--. Column 14, line 51, "134" should be --124--. Column 16, line 57, "if" should be --it--. Column 17, line 39 (Claim 2, line 20), a hyphen should appear between "logic inhibit". Column 18, line 32 (Claim 17, line 6), "bypass" should be written --by-pass--; line 54 (Claim 24, line 1), "3" should be --2--. Column 20, line 26 (Claim 33, line 17), following "by-pass" should be --flow--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*